United States Patent [19]

Riefenthaler

[11] 4,153,385

[45] May 8, 1979

[54] SELF-DRAWING CENTRIFUGAL PUMP

[75] Inventor: Johann Riefenthaler, Korneuburg, Austria

[73] Assignee: Spezialfabrik moderner Pumpen Ernst Vogel, Stockerau, Austria

[21] Appl. No.: 795,361

[22] Filed: May 9, 1977

[30] Foreign Application Priority Data

May 12, 1976 [AT] Austria ..... 3453/76

[51] Int. Cl.[2] ..... F01D 1/12

[52] U.S. Cl. ..... 415/53 R; 415/209; 415/211

[58] Field of Search ..... 415/52, 53 R, 209, 210, 415/211; 417/68

[56] References Cited

U.S. PATENT DOCUMENTS

| | | | |
|---|---|---|---|
| 961,993 | 6/1910 | Valk | 415/13 |
| 2,291,760 | 8/1942 | Rupp | 415/53 |
| 2,653,546 | 9/1953 | Marlow, Jr. | 415/53 R |
| 2,945,448 | 7/1960 | Frederick | 415/53 R |
| 2,951,449 | 9/1960 | Blarcom, Jr. et al. | 415/53 R |
| 3,045,603 | 7/1962 | Hunter | 415/53 R |
| 3,103,177 | 9/1963 | Gatto et al. | 415/53 R |
| 3,286,639 | 11/1966 | Hutton | 415/53 R |
| 3,416,456 | 12/1968 | Pollak et al. | 415/53 R |

FOREIGN PATENT DOCUMENTS

| | | | |
|---|---|---|---|
| 272848 | 7/1969 | Austria | 415/53 R |
| 1386510 | 3/1975 | United Kingdom | 415/53 R |

*Primary Examiner*—C. J. Husar

*Attorney, Agent, or Firm*—Blanchard, Flynn, Theil, Boutell & Tanis

[57] ABSTRACT

A self-drawing centrifugal pump having a distributor with asymmetrical blades thereon and at least one inflow or recirculation opening therein. Flaps or the like are arranged on the distributor and serve to close off the channels during the suction phase of the pump. After flow has started, the flaps are adapted to open slightly at first and eventually all the way open to render the entire cross section of the channels available for fluid flow. A portion of the fluid flow is returned through the inflow or recirculation opening to the rotor space or into the outermost part of the rotor where it is again mixed with air and subsequently conveyed away.

3 Claims, 1 Drawing Figure

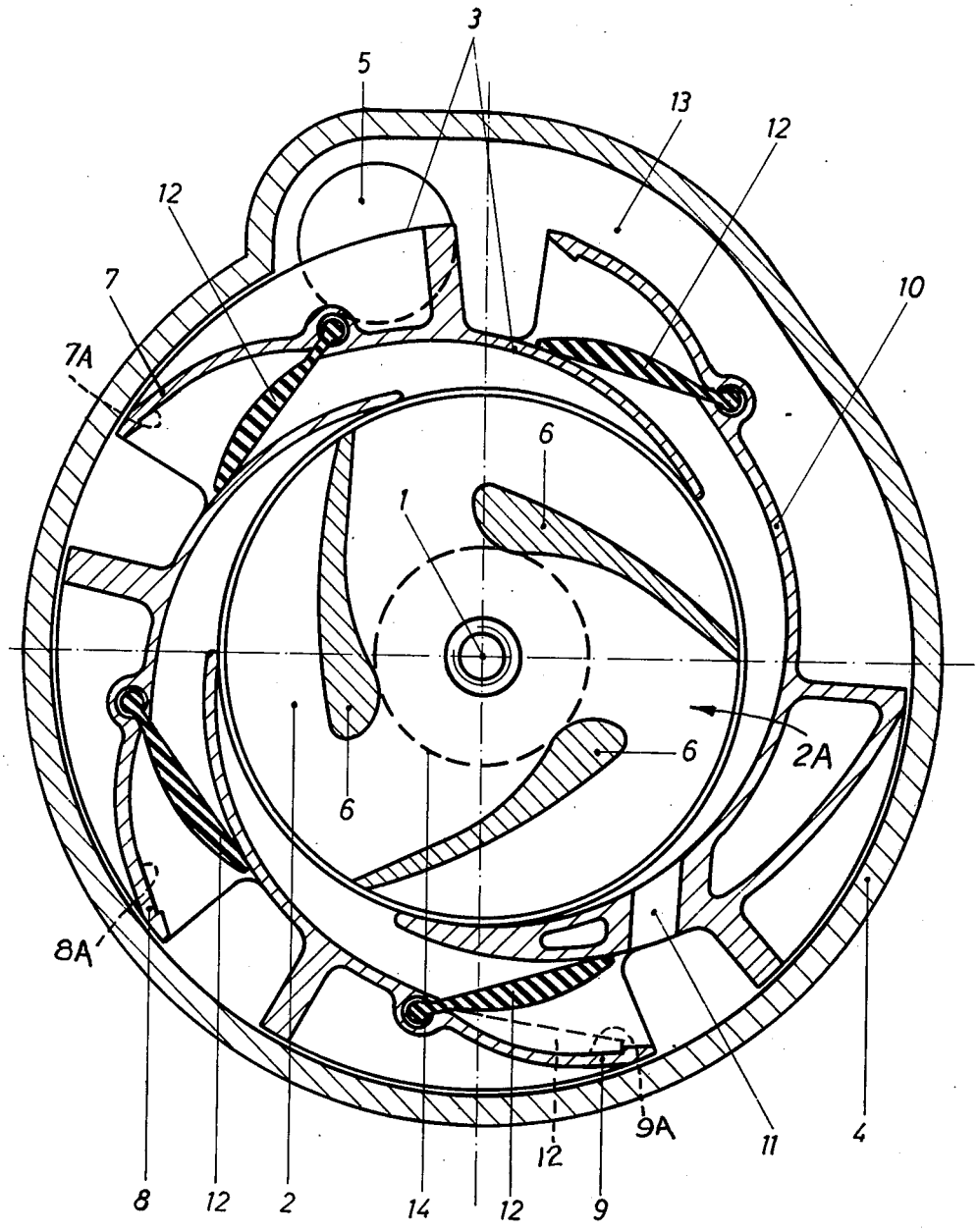
3
5
13
12
12
7
10
7A
6
1
6
2A
6
8A
9A
11
4
12
8
12
2
14
12
9

SELF-DRAWING CENTRIFUGAL PUMP

FIELD OF THE INVENTION

The invention relates to a self-drawing centrifugal pump having a distributor with asymmetrical blading which is constructed with at least one inflow or recirculation opening.

BACKGROUND OF THE INVENTION

Centrifugal pumps are in their usual design not self-drawing, which means they are not capable to evacuate even only relatively short suction pipes and to pass over into a normal pump operation after moving the air which is in the suction pipe away.

The self-drawing capability and thus the capability to move a limited amount of air is of importance for all those cases in which it is not possible to provide a check valve, for example a foot valve, in the suction pipe, where same, for example caused by contamination of the liquid, does not reliably seal.

In order to make a normal centrifugal pump self-drawing, various measures are known, which are divided basically into measures on the rotor, for example:

Mounting of an auxiliary rotor on the back side of the rotor with connecting channels to the main rotor or Construction of the rotor with at least one channel constriction in order to achieve a turbulence, and into measures on the stationary pump part, for example Construction of the spiral housing with a drawing pipe on the housing projection (see for example Austrian Pat. No. 272,848), Arrangement of a by-pass from the pressure to the suction side (with or without lock after the end of evacuation) and asymmetric construction of the distributor with an inflow or recirculation opening.

These known measures are disadvantageous in as far as they either, during the phase of the movement of the liquid, very strongly reduce the efficiency or require additional structural measures on the pump housing, which on the one hand substantially increases the manufacturing price and on the other hand make the pump substantially larger.

For example the known construction with the asymmetrical distributor, on which the present invention is based, requires special measures on the pressure side, for example a pressure tight water box, so that the liquid gas mixture can calm down and the escape of gas from the liquid is made possible.

Aside from the expenses of this construction there are cases of use where such enlarged pressure chambers cannot be used for reasons of available space or because of the outer shape.

Thus the basic purpose of the invention is to provide a centrifugal pump of the above described type in which these disadvantages are voided. This is inventively achieved by arranging flaps or the like in the channels of the distributor, through which flaps the channels can be closed off or blocked during the suction phase.

The blades of the distributor are preferably constructed with recesses for receiving the flaps. The flaps may be either spring-loaded or resilient.

Since in this pump the liquid gas mixture leaves the distributor without any substantial speed, the gas, in particular the air, which is contained in it, can be given out easier. The air cannot return into the rotor space, but rises and is moved away through the pressure port, however, the degassed liquid returns through at least one inflow or recirculation opening which is arranged preferably far down into the rotor space where it again is mixed with air and is moved away with same until the suction pipe is completely evacuated.

After the evacuation is completed, full conveying starts and the flaps in the channels open up according to the increasing conveyed stream until the cross section is fully utilized. The small throttle effect caused by the counterspringiness of the flaps is of no importance during the strong flow during the normal liquid conveyance of the pump. Also the loss in efficiency caused by the constant backflow through the inflow or recirculation opening can be absorbed easily, if same is arranged on the side of the pump which lies opposite to the pressure port.

BRIEF DESCRIPTION OF THE DRAWING

The subject matter of the invention is discussed more in detail hereinafter with reference to an exemplary embodiment illustrated in the drawing.

The drawing illustrates a normal axial cross section of an inventive pump.

DETAILED DESCRIPTION

The pump consists of a housing 4 having a distributor 3 defining a pump chamber 2A in which is arranged a rotor or impeller 2 which is driven by means of a shaft 1. A pressure port 5 projects from the pump housing 4. The rotor 2 has symmetrically arranged rotor blades 6, however, the distributor 3 is constructed with blades 7, 8 and 9 which extend at a normal pitch and an asymmetric blade 10 which extends over two pitches, and which blade 10 is provided with an inflow or recirculation opening. In the channels of the distributor there are arranged for example flaps 12 which are made of rubber and which are resilient, and which flaps— as this is shown — almost completely close off the channels of the distributor 3 during the suction phase of the pump. Alternatively the flaps 12 may also be under spring action. In addition, recesses *7a*, *8a*, *9a*are preferably provided in the walls of the channels, which recesses can receive the flaps 12, so that when the flaps are open the full channel cross section is released as shown in broken lines with reference to recess 9A.

To operate the pump, the pump housing 4 must be filled, for example by means of the pressure port 5, approximately halfway with liquid. After the pump was started, the liquid is driven outwardly by a rotation of the rotor 2 and air is simultaneously sucked in from the suction pipe. As a result, a ring flow is produced on the outside of the rotor 2, which ring flow is formed of a mixture of liquid and air. The individual blades 7, 8 and 9 of the distributor peel this ring flow off and cause it to flow through the channels into the pressure chamber 13 of the pump.

Since the flaps 12 which are arranged in the channels of the distributor 3 almost close off the channels, the flow can just yet leave the channels in slowed-down form. Since through this a small liquid movement occurs now in the pressure or air separation chamber 13, the air can escape and reach the pressure port 5. However, the liquid flows out of the pressure chamber 13 and can, favored by the flow asymmetry caused by the distributor blade 10, flow through the inflow or recirculation opening 11 again into the rotor space or into the outermost part of the rotor 2 where it is anew mixed with air and subsequently moved away. Thus a ring flow is constantly being formed in the liquid and in the air which flow in a circulate manner, the air being taken from the suction pipe and conveyed from the suction port to the pressure port.

This continues until the suction pipe is evacuated and liquid flows into the suction port 14 of the rotor 2. The normal conveying is built up on this. The resilient flaps 12 are thereby adjusted through the substantially enlarged conveyed stream which causes the full cross section in the channels of the distributor 3 to be available. The small excess pressure at the inflow opening 11, which results from the speed reduction in the enlarging channels of the distributor, causes a constant, however, easily absorbable circulation of conveyor liquid.

Common circular pumps become self-drawing through the described measures without requiring for the needed measures a change in the outside dimensions.

The embodiments of the invention in which an exclusive proverty or privilege is claimed are defined as follows:

1. In a self-drawing centrifugal pump having an inlet port and an outlet port, comprising a housing having a distributor member defining a pumping chamber separated from an air separating outlet chamber, a rotatable impeller supported in said pumping chamber, said distributor member including a plurality of circumferentially spaced blades and radial passageways therethrough circumferentially spaced around said pumping chamber to provide communication between said pumping chamber and said outlet chamber, said distributor member having a recirculation port near the bottom of said pumping chamber, said recirculation port providing direct communication between said chambers, the improvement comprising wherein said blades and said radial passageways are asymmetrically spaced around said pumping chamber and wherein a movably supported flap is provided in each of said radial passageways movable between opened and blocked positions across said radial passageways, said flaps each being resiliently biased to initially block said radial passageways and being openable in response to a small pressure differential thereacross to facilitate a flow of fluid media only from said pumping chamber to said outlet chamber.

2. The improved centrifugal pump according to claim 1, wherein the blades of the distributor are constructed with recesses for receiving the flaps.

3. The improved centrifugal pump according to claim 1, wherein said flaps are spring-loaded or resilient.

* * * * *